US009879371B2

(12) United States Patent
Leibman et al.

(10) Patent No.: US 9,879,371 B2
(45) Date of Patent: Jan. 30, 2018

(54) WASHING MACHINE APPLIANCE WITH AN INTEGRATED WATER-ON-DEMAND FEATURE

(71) Applicant: General Electric Company, Schectady, NY (US)

(72) Inventors: Alexander Boris Leibman, Prospect, KY (US); Mark Anthony Didat, Floyds Knobs, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 42 days.

(21) Appl. No.: 14/996,387

(22) Filed: Jan. 15, 2016

(65) Prior Publication Data

US 2017/0204553 A1 Jul. 20, 2017

(51) Int. Cl.
*D06F 39/02* (2006.01)
*D06F 39/00* (2006.01)

(52) U.S. Cl.
CPC ..... *D06F 39/028* (2013.01); *D06F 39/005* (2013.01); *D06F 39/02* (2013.01)

(58) Field of Classification Search
None
See application file for complete search history.

(56) References Cited

U.S. PATENT DOCUMENTS

| | | | | |
|---|---|---|---|---|
| 3,301,022 | A * | 1/1967 | Low | D06F 33/02 137/387 |
| 5,315,847 | A * | 5/1994 | Takeda | G01N 27/07 324/439 |
| 6,353,954 | B1 * | 3/2002 | Dunsbergen | D06F 39/022 68/17 R |
| 8,561,438 | B2 * | 10/2013 | Jeong | D06F 31/00 68/13 R |
| 2005/0188729 | A1 | 9/2005 | Zsambeki et al. | |
| 2009/0053119 | A1 * | 2/2009 | Richman | D06F 39/02 422/300 |
| 2010/0000578 | A1 * | 1/2010 | Hendrickson | D06F 39/022 134/34 |
| 2014/0352364 | A1 * | 12/2014 | Martinez Villarreal | D06F 39/022 68/17 R |
| 2016/0047077 | A1 * | 2/2016 | Leibman | D06F 39/028 68/17 R |

FOREIGN PATENT DOCUMENTS

| | | |
|---|---|---|
| WO | WO2013169005 A1 | 11/2013 |
| WO | WO2015133734 A1 | 9/2015 |

* cited by examiner

*Primary Examiner* — Jason Y Ko
(74) *Attorney, Agent, or Firm* — Dority & Manning, P.A.

(57) ABSTRACT

A washing machine having an integrated water-on-demand feature is provided. The washing machine appliance allows a user to adjust the water or wash liquid fill amount of the washing machine appliance using an actuator integrated into or positioned nearby the dispenser box, thereby enabling a simple, convenient, and effective manner of adding wash liquid without requiring a substantial number of additional parts or assembly.

18 Claims, 6 Drawing Sheets

WASHING MACHINE APPLIANCE WITH AN INTEGRATED WATER-ON-DEMAND FEATURE

FIELD OF THE INVENTION

The present subject matter relates generally to washing machine appliances and more particularly to washing machine appliances having a system for adding supplemental wash liquid.

BACKGROUND OF THE INVENTION

Washing machine appliances generally include a tub for containing water or wash liquid, e.g., water and detergent, bleach, and/or other wash additives. A basket is rotatably mounted within the tub and defines a wash chamber for receipt of articles for washing. During normal operation of such washing machine appliances, the wash liquid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash liquid is directed into the tub in order to wash and/or rinse articles within the wash chamber. One or more fluid additives may be added to the wash liquid to enhance the cleaning or other properties of the wash liquid. The fluid additives may be in powder or concentrated liquid form, and are generally added to a dispenser box of the washing machine appliance by, e.g., a user of the washing machine appliance. The dispenser box may contain various chambers for containing different additives, e.g., wash detergent and softener. Water may be directed into the chambers of the dispenser box through a plurality of water inlet valves to mix with the additives and the resulting wash liquid is then dispensed into the wash chamber.

The volume of water or wash liquid needed may vary depending upon a variety of factors. For example, large loads can require a large volume of water relative to small loads that can require a small volume of water. A user may wish to have additional wash liquid dispensed in order to perform a specific task, e.g., prewash an article of clothing or add additional liquid to accommodate an extra large load. The ability to adjust the amount of water or wash liquid dispensed is a generally commercially desirable feature and increases the user's positive perception of the wash process generally. However, conventional washing machine appliances typically do not have water-on-demand features, and those that do require additional nozzles, hoses, clamps, and other hardware to perform such a function.

Accordingly, a washing machine appliance that provides a user with more control over the water or wash liquid fill amount is desirable. In particular, a dispenser box having a simple, convenient, integrated system for dispensing an additional predetermined amount of wash liquid would be particularly beneficial.

BRIEF DESCRIPTION OF THE INVENTION

The present subject matter provides a washing machine having an integrated water-on-demand feature. More particularly, the present subject matter provides a washing machine appliance that allows a user to adjust the water or wash liquid fill amount of the washing machine appliance using an actuator integrated into or positioned nearby the dispenser box, thereby enabling a simple, convenient, and effective manner of adding wash liquid without requiring a substantial number of additional parts or assembly. Additional aspects and advantages of the invention will be set forth in part in the following description, or may be apparent from the description, or may be learned through practice of the invention.

In one exemplary embodiment, a washing machine appliance defining a vertical, a lateral, and a transverse direction is provided. The washing machine appliance includes a cabinet; a tub positioned within the cabinet; and a wash basket rotatably mounted within the tub, the wash basket defining a wash chamber for receiving articles for washing. The washing machine appliance further includes an additive dispenser positioned within the cabinet and configured to provide wash liquid to the tub. The additive dispenser includes a mixing chamber configured to receive wash additive and a water valve configured to provide a flow of water to the mixing chamber from a water inlet. The additive dispenser further includes a user input button for adding supplemental water to the tub and a controller in operative communication with both the user input button and the water valve. The controller is configured to receive a user input to add a supplemental water fill amount to the tub and open the water valve to provide the tub with the supplemental water fill amount.

In another exemplary embodiment, a dispensing assembly for a washing machine appliance having a tub positioned within a cabinet is provided. The dispensing assembly includes a water valve configured to provide a flow of water from a water inlet and a dispenser box positioned within the cabinet, the dispenser box comprising a mixing chamber configured to receive the flow of water and dispense the flow of water into the tub. The dispensing assembly further includes a user input button and a controller in operative communication with both the user input button and the water valve. The controller is configured to open the water valve to provide the tub with a supplemental water fill amount responsive to the user input button being pressed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
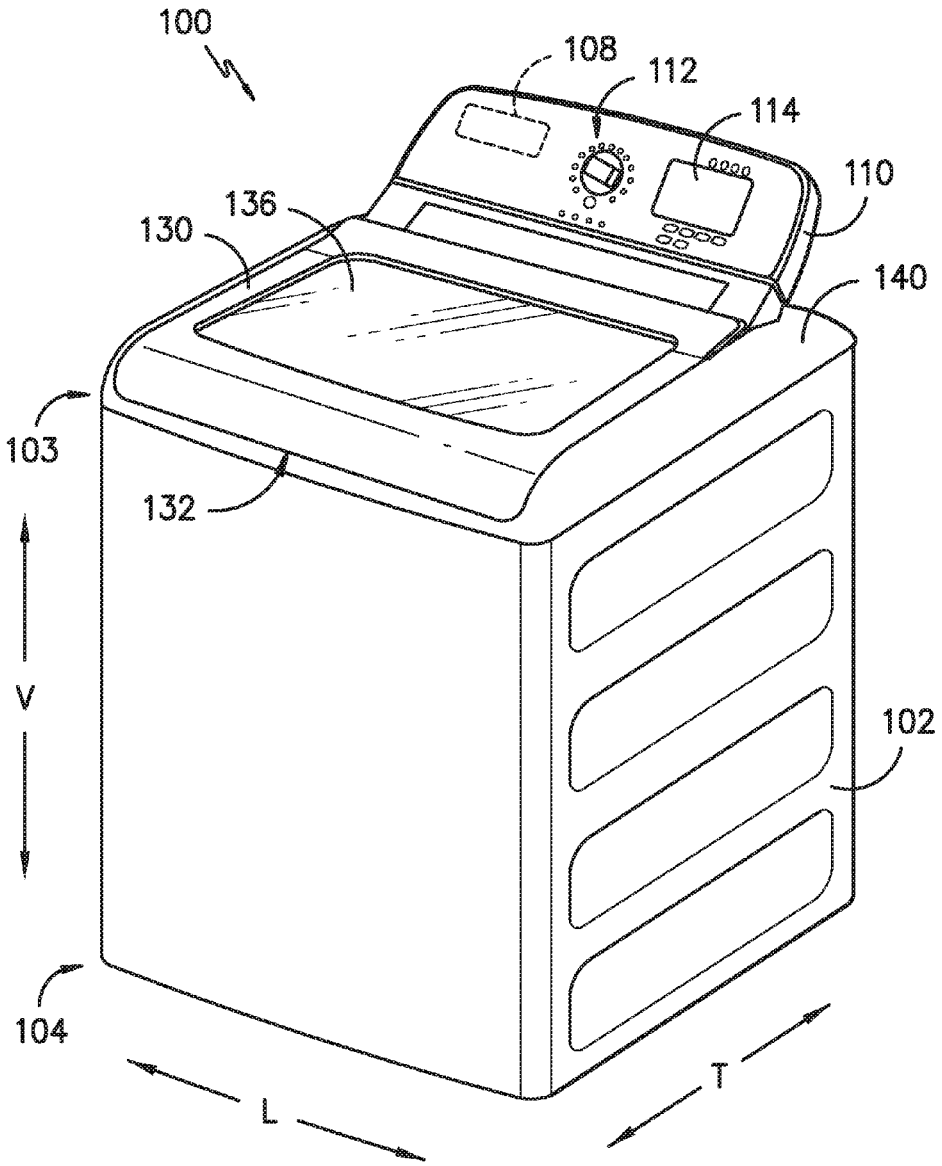
FIG. 1 provides a perspective view of a washing machine appliance according to an exemplary embodiment of the present subject matter with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
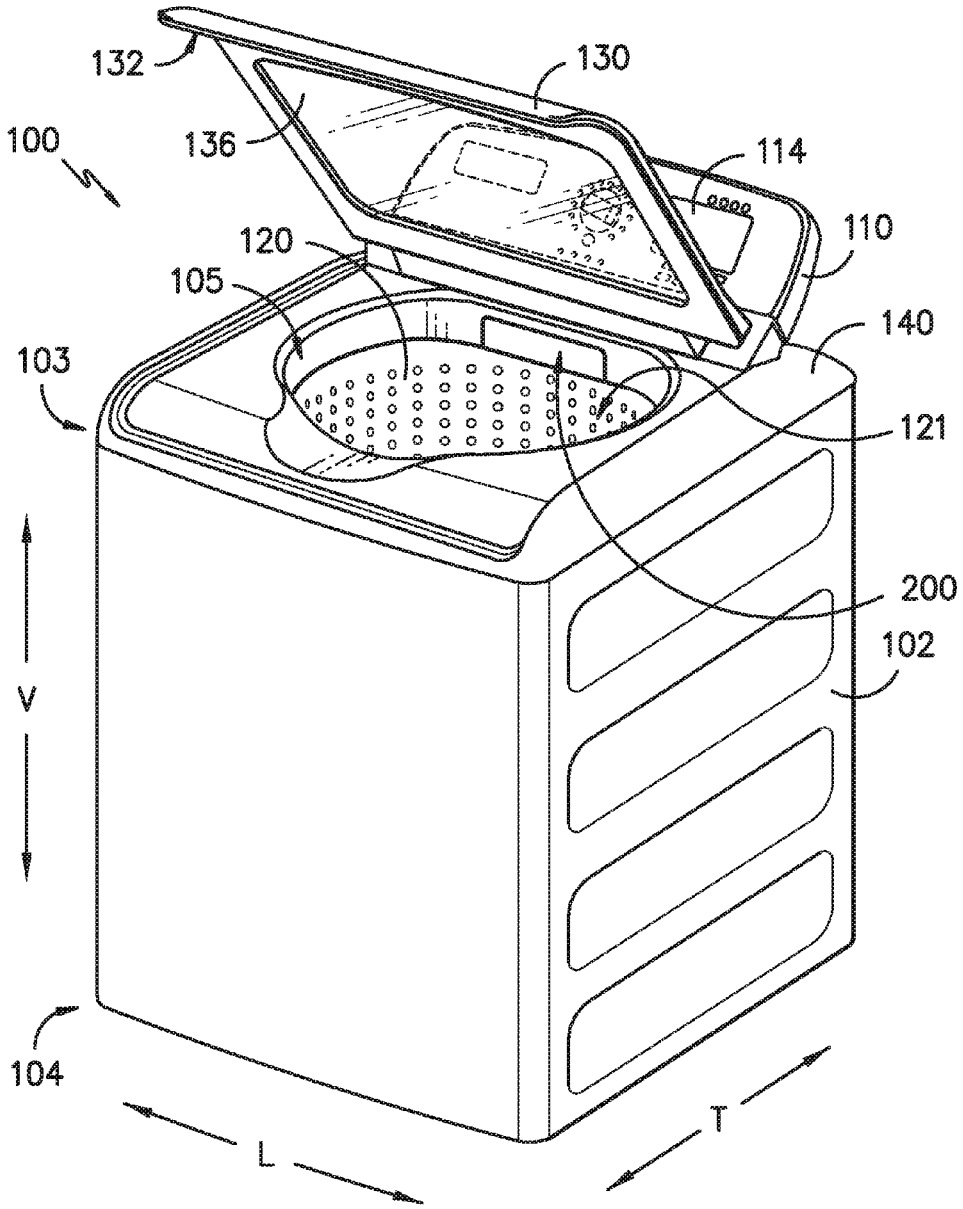
FIG. 2 provides a perspective view of the exemplary washing machine appliance of FIG. 1 with the door of the exemplary washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along the vertical direction V. A wash basket 120 (FIG. 2) is rotatably mounted within cabinet 102. A motor (not shown) is in mechanical communication with wash basket 120 to selectively rotate wash basket 120 (e.g., during an agitation or a rinse cycle of washing machine appliance 100). Wash basket 120 is received within a wash tub or wash chamber 121 (FIG. 2) and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller assists agitation of articles disposed within wash basket 120 during operation of washing machine appliance 100.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are loaded into wash basket 120 through opening 105, and washing operation is initiated through operator manipulation of input selectors 112. Wash basket 120 is filled with water and detergent and/or other fluid additives via dispenser box assembly 200, which will be described in detail below. One or more valves can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle and/or after the rinse cycle to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash basket 120 through opening 105.

Referring now generally to FIGS. 2 through 6, dispenser box assembly 200 will be described in more detail. Although the discussion below refers to dispenser box assembly 200, one skilled in the art will appreciate that the features and configurations described may be used for other additive dispensers in other washing machine appliances as well. For example, dispenser box assembly 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

Figure 3:
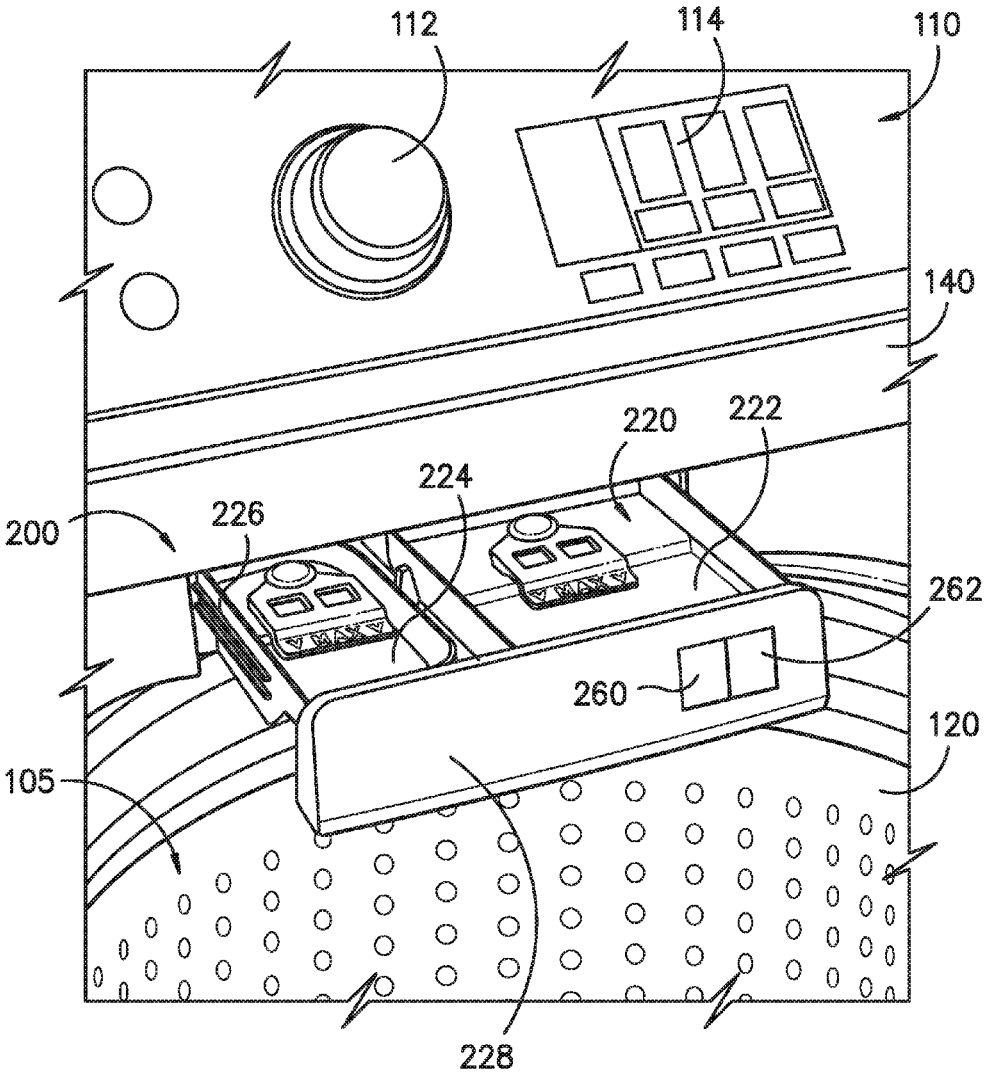
FIG. 3 provides a front, perspective view of an exemplary dispenser box assembly installed in the exemplary washing machine appliance of FIG. 1.
Figure 4:
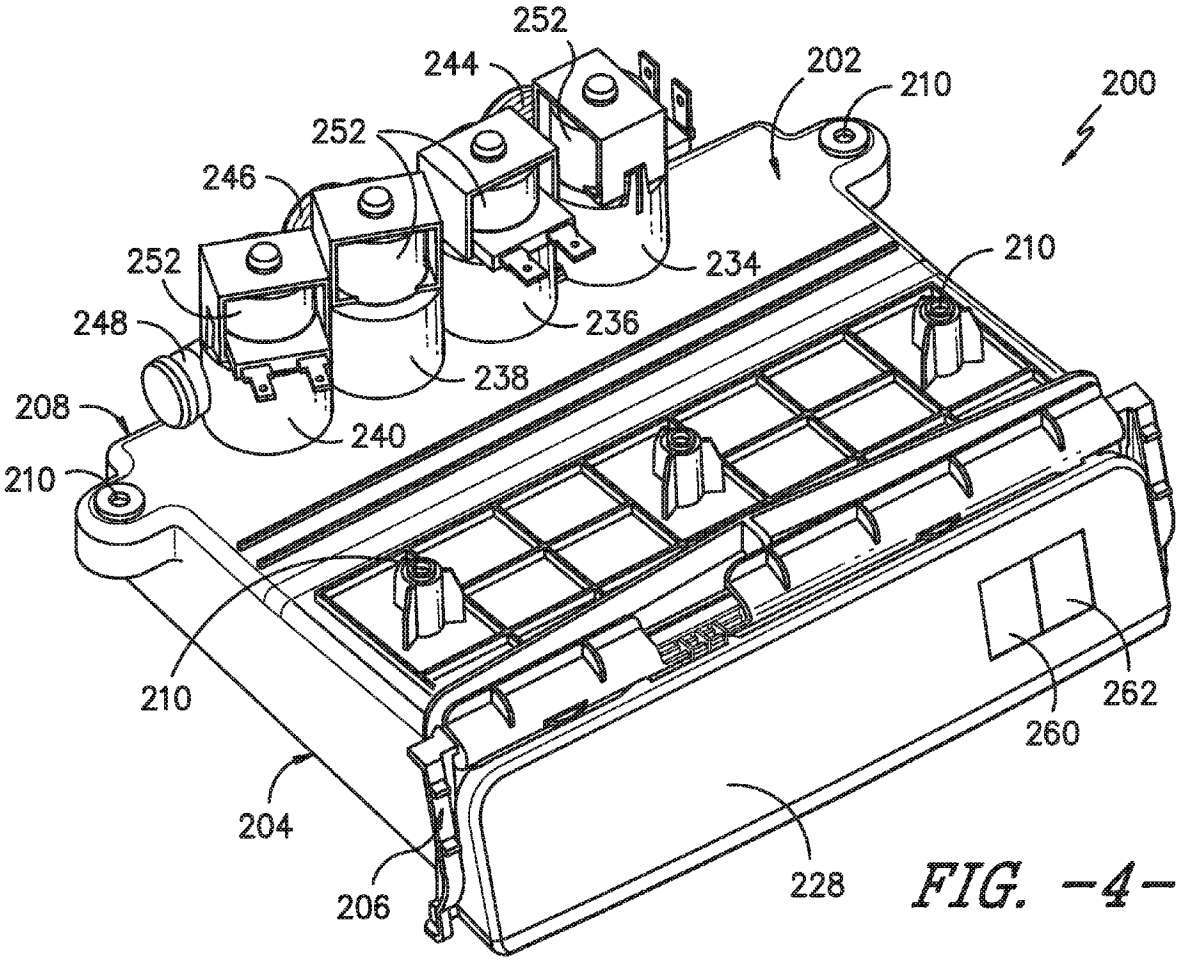
FIG. 4 provides a front, perspective view of the exemplary dispenser box assembly of FIG. 3.

Dispenser box assembly 200 is a box having a substantially rectangular cross-section that defines a top 202 and a bottom 204 spaced apart along the vertical direction V. Dispenser box assembly 200 also defines a front side 206 and a back side 208 spaced apart along the transverse direction T. As best shown in FIGS. 2 and 3, dispenser box assembly 200 may be mounted underneath top panel 140 of cabinet 102 such that front side 206 is visible inside opening 105. More specifically, dispenser box assembly 200 may be mounted to top panel 140 using a plurality of mounting features 210, which may, for example, be configured to receive mechanical fasteners. One skilled in the art will appreciate that dispenser box assembly 200 may be mounted in other locations and use other mounting means according to alternative exemplary embodiments.

Dispenser box assembly 200 may define a mixing chamber 220 configured to receive one or more additive compartments. For example, according to the illustrated embodiment, mixing chamber 220 may be configured to slidably receive a detergent compartment 222 and a softener compartment 224. Compartments 222, 224 are slidably connected to the mixing chamber 220 using slides 226 and are connected to a front panel 228 of dispenser box assembly. In this manner, a user may pull on front panel 228 to slide compartments 222, 224 along the transverse direction T. Once extended, detergent compartment 222 and softener compartment 224 may be conveniently filled with detergent and softener, respectively. Front panel 228 may be then be pushed back into mixing chamber 220 before a wash cycle begins.

Although the illustrated embodiment shows detergent compartment 222 and softener compartment 224 slidably received in mixing chamber 220 for receiving wash additives, one skilled in the art will appreciate that different configurations are possible in alternative exemplary embodiments. For example, more compartments may be used and the compartments may be accessed by a lid instead of sliding out of mixing chamber 220. Alternatively, mixing chamber 220 may draw wash additives from a separate storage container such that sliding compartments 222, 224 are not needed. Other configurations of mixing chamber 220 and compartments 222, 224 are also possible and within the scope of the present subject matter.

Dispenser box assembly 200 may further include a plurality of valves configured to supply hot and cold water to mixing chamber 220 or directly to wash tub 121. For example, according to the illustrated embodiment, a plurality of apertures may be defined on top 202 of mixing chamber 220 for receiving water. Each aperture (not shown) may be in fluid communication with a different portion of the mixing chamber. A plurality of valve seats may be positioned over top of each of those apertures to receive a valve that controls the flow of water through each aperture.

For example, a first valve seat 234 may be in fluid communication with a first aperture for providing hot water into detergent compartment 222. A second valve seat 236 may be in fluid communication with a second aperture for providing cold water into detergent compartment 222. A third valve seat 238 may be in fluid communication with a third aperture for providing cold water into softener compartment 224. A fourth valve seat 240 may be in fluid communication with a fourth aperture for providing cold water into mixing chamber 220 or directly into wash tub 121.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Figure 5:
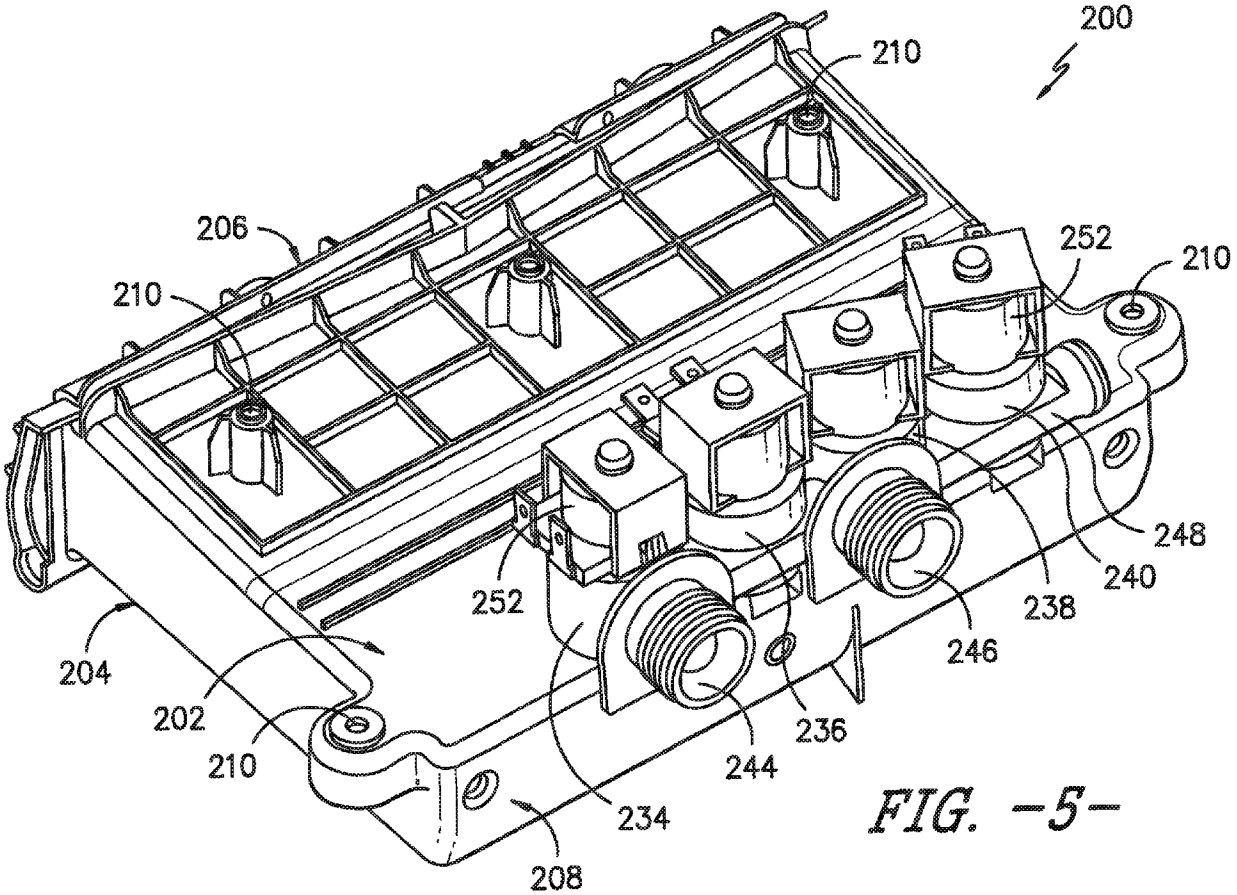
FIG. 5 provides a rear, perspective view of the exemplary dispenser box assembly of FIG. 3.
Figure 6:
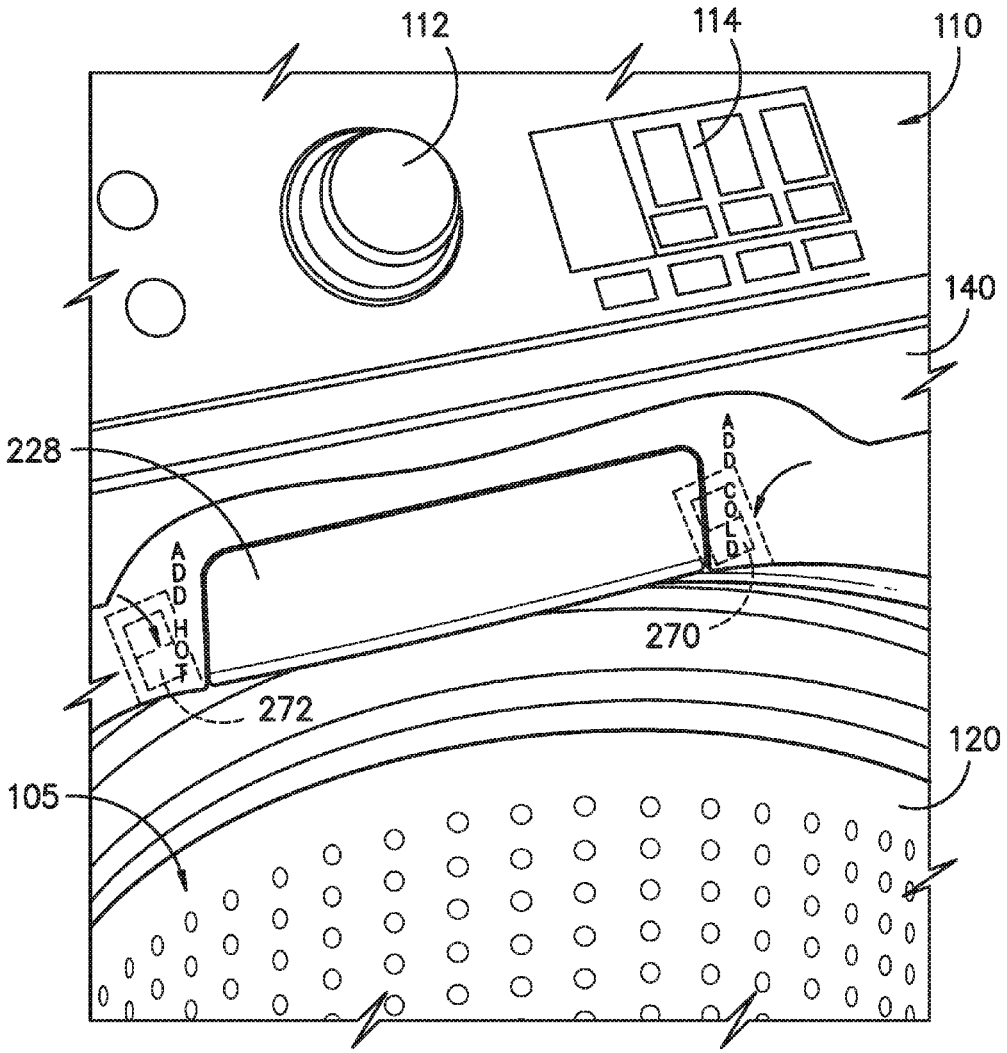
FIG. 6 provides a front, perspective view of a front portion of a dispenser box according to another exemplary embodiment of the present subject matter.

Notably, hot water inlet 244 is in direct fluid communication with first valve seat 234. However, because washing machine appliance 100 uses cold water for multiple purposes, cold water inlet is in fluid communication with a cold water manifold 248. As best shown in FIG. 5, cold water manifold 248 is a cylindrical pipe that extends along the lateral direction from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

Dispenser box assembly 200 may further include one or more nozzles (not shown) for directing wash fluid, such as water and/or a mixture of water and at least one fluid additive, e.g., detergent, fabric softener, and/or bleach into wash tub 121 from dispenser box assembly 200. For example, when second valve seat 236 is open, water may flow from cold water inlet 246 through cold water manifold 248 and second valve seat 236 into detergent compartment 222. Water may mix with detergent placed in detergent compartment 222 to create wash liquid to be dispensed into wash tub 121.

A nozzle (not shown) may be placed on the bottom of detergent compartment 222 or on the bottom of mixing chamber 220 to dispense the wash fluid into wash tub 121. According to the illustrated embodiment, dispenser box assembly 200 may include four nozzles associated with valves seats 234, 236, 238, 240, respectively. However, it will be understood that different nozzle configurations may be used in alternative exemplary embodiments. For example, nozzles may be positioned on a bottom of mixing chamber 220 near wash tub 121 or directly on wash tub 121, but could be positioned in other locations as well.

In some situations, a user may wish to add additional water to wash tub 121. For example, a user may wish to prewash one or more articles of clothing or may perceive that more water is needed to effectively wash a load.

Accordingly, dispenser box assembly 200 may include a system for allowing a user to add water to wash tub 121 on demand, i.e., a water-on-demand feature.

In this regard, dispenser box assembly 200 may include one or more buttons that are configured to control one or more of valves 252. According to the exemplary embodiment illustrated in FIG. 3, dispenser box assembly 200 includes a cold water button 260 and a hot water button 262 for controlling valves 252 on first valve seat 234 and fourth valve seat 240, respectively. However, one skilled in the art will appreciate that additional buttons may be included and the buttons may control different valves 252 or any combination of valves 252. For example, a third button may be configured to add a "soapy" mixture of hot and/or cold water with a wash additive. In addition, one skilled in the art will appreciate that any of these buttons can be turned on/off independently or together in any combination.

Cold water button 260 and hot water button 262 may be any button or switch suitable for providing an indication to controller 108 that a particular action should be initiated. For example, buttons 260, 262 may be push button switches, toggle switches, rocker switches, or any other suitable tactile switch, such as capacitive touch buttons. According to the illustrated embodiments, buttons 260, 262 are momentary switches (sometimes referred to as mom-off-mom switches). In this regard, buttons 260, 262 are biased switches that return to their unlatched or unpressed state when released, e.g., by spring force.

According to the exemplary embodiment illustrated in FIG. 3, cold water button 260 and hot water button 262 may be located on front panel 228 of dispenser box assembly 200. According to an alternative exemplary embodiment illustrated in FIG. 6, a cold water button 270 and a hot water button 272 may be placed on a bottom surface of top panel 140 adjacent to dispenser box assembly 200. For example, cold water button 270 may be placed just to the right of mixing chamber 220 and hot water button 272 may be placed just to the left of mixing chamber 220. In this manner, when a user desires additional water, the user may insert their finger between top panel 140 and wash basket 120 to actuate buttons 270, 272.

According to other embodiments, buttons 260, 262 may be placed in any other suitable location that is easy to access by a user. As illustrated for washing machine appliance 100, buttons 260, 262, 270, 272 are all positioned in front of control panel 110. This may be advantageous because washing machine appliance 100 is a vertical axis, top load washing machine that has door 130 that pivots up, thereby blocking access to control panel 110 when door 130 is in the open position. Thus, buttons 260, 262, 270, 272 are preferably located somewhere within wash tub 121 that is easily accessible when door 130 blocks access to control panel 110.

Notably, buttons 260, 262 are positioned in a location of washing machine appliance 100 where they may be exposed to very humid, damp conditions, or where they may be directly sprayed with water. Therefore, it is desirable that buttons 260, 262 operate at a low voltage in order to prevent the possibility of shocking the user. More particularly, buttons 260, 262 may operate on an isolated Safety Extra Low Voltage (SELV) circuit. In this regard, buttons 260, 262 may be sealed and rated for direct contact with water. Buttons 260, 262 may be directly connected with controller 108 and may be configured for operation at a low voltage, e.g., 5 volts. When buttons 260, 262 are pressed, controller 108 may control valves 252 at the required 120 volts. In this manner, buttons 260, 262 are safe for the user to operate even in the damp conditions within wash tub 12 without the risk of shock.

Notably, buttons 260, 262 may be placed directly on dispenser box assembly 200 or in very close proximity to mixing chamber 220. In addition, buttons 260, 262 may control valves 252 that are already included on washing machine appliance 100. This obviates the need for additional hardware required for an independent water delivery system, e.g., nozzles, high voltage circuits, mounting hardware, etc. As a result, the water-on-demand feature provides an inexpensive, reliable, simple, and intuitive system to deliver additional water to wash tub 121 when the user desires. Similarly, because valves 252 and water delivery system are integrated into an existing dispenser box assembly 200, washing machine appliance 100 may have a more aesthetically pleasing appearance.

Buttons 260, 262 may be used by a user to deliver an additional amount of water to wash tub 121 on demand, e.g., during or prior to any wash cycle. The additional amount of water may be a specific volume of water or valves 252 may simply be opened for a specific amount of time. For example, according to an exemplary embodiment, pressing hot water button 262 will open valve 252 seated on first valve seat 234 and deliver hot water to detergent compartment 222 or mixing chamber 220 for 20 seconds. However, one skilled in the art will appreciate that water may be delivered for other time durations as controlled by the user, e.g., via settings on controller 108, or as set by the manufacturer. Indeed, these values may be set by the manufacturer, determined by controller 108 based on the operating parameters selected, selected by the consumer, or set in any other suitable manner.

One skilled in the art will appreciate that the amount of water added to wash tub 121 upon pressing buttons 260, 262 may vary depending on the application or wash cycle. Similarly, the amount of water delivered may be preset (as described above) such that pressing buttons 260, 262 delivers the predetermined amount of water. Alternatively, valves 252 may be configured to remain open at all times when corresponding buttons 260, 262 are depressed. In this manner, a user may precisely control the amount of water added to wash tub 121. In order to ensure that wash tub 121 is never overfilled, a maximum water level sensor may be included in the wash tub 121. When water reaches the maximum level, controller 108 may automatically close all valves 252 or perform a drain cycle to prevent water from spilling out of wash tub 121.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet defining a top panel;

a tub positioned within the cabinet;

a wash basket rotatably mounted within the tub, the wash basket defining a wash chamber for receiving articles for washing;

an additive dispenser positioned within the cabinet and underneath the top panel such that it is accessible only when a lid of the washing machine appliance is open, the additive dispenser being configured to provide wash liquid to the tub, the additive dispenser comprising:

a mixing chamber configured to receive wash additive; and a water valve configured to provide a flow of water to the mixing chamber from a water inlet;

a user input button for adding supplemental water to the tub, the user input button being mounted to a front surface of the additive dispenser; and a controller in operative communication with both the user input button and the water valve, the controller configured to:

receive a user input to add a supplemental water fill amount to the tub; and open the water valve to provide the tub with the supplemental water fill amount.

2. The washing machine appliance of claim 1, wherein the water valve is a solenoid valve that operates at approximately 120 volts.

3. The washing machine appliance of claim 2, wherein the user input button is operatively connected to the controller and operates at approximately 5 volts, the controller selectively controlling the operation of the solenoid valve in response to the user input button.

4. The washing machine appliance of claim 1, wherein the water valve is a cold water valve and the user input button is a first user input button, the washing machine further comprising:

a hot water valve configured to provide a flow of hot water to the mixing chamber from a hot water inlet; and second user input button for adding supplemental hot water to the tub, wherein the controller is configured to open the cold water valve for a predetermined amount of time when the first user input button is pressed and open the hot water valve for a predetermined amount of time when the second user input button is pressed.

5. The washing machine appliance of claim 1, wherein the user input button is a momentary switch.

6. The washing machine appliance of claim 1, wherein when the controller is configured to open the water valve for a predetermined amount of time when the user input button is pressed.

7. The washing machine appliance of claim 1, wherein the user input button is configured for adding a mixture of supplemental water and a wash additive to the tub.

8. The washing machine appliance of claim 1, wherein the user input button is mounted between the top panel and the wash basket.

9. The washing machine appliance of claim 1, wherein the washing machine appliance is a vertical axis washing machine appliance.

10. A dispensing assembly for a washing machine appliance having a tub positioned within a cabinet, the dispensing assembly comprising:

a water valve configured to provide a flow of water from a water inlet;

a dispenser box positioned within the cabinet, the dispenser box comprising a mixing chamber configured to receive the flow of water and dispense the flow of water into the tub;

a user input button, the user input button being mounted to a front surface of the dispenser box, the dispenser box being located underneath a top panel of the cabinet such that it is accessible only when a lid of the washing machine appliance is open; and a controller in operative communication with both the user input button and the water valve, the controller configured to open the water valve to provide the tub with a supplemental water fill amount responsive to the user input button being pressed.

11. The dispensing assembly of claim 10, wherein the water valve is a solenoid valve that operates at approximately 120 volts.

12. The dispensing assembly of claim 11, wherein the user input button is operatively connected to the controller and operates at approximately 5 volts, the controller selectively controlling the operation of the solenoid valve in response to the user input button.

13. The dispensing assembly of claim 10, wherein the water valve is a cold water valve and the user input button is a first user input button, the dispensing assembly further comprising:

a hot water valve configured to provide a flow of hot water from a hot water inlet; and second user input button, wherein the controller is configured to open the cold water valve for a predetermined amount of time when the first user input button is pressed and open the hot water valve for a predetermined amount of time when the second user input button is pressed.

14. The dispensing assembly of claim 10, wherein the user input button is a momentary switch.

15. The dispensing assembly of claim 10, wherein when the controller is configured to open the water valve for a predetermined amount of time when the user input button is pressed.

16. The dispensing assembly of claim 15, wherein the predetermined amount of time is 20 seconds.

17. The dispensing assembly of claim 10, wherein the user input button is mounted between the top panel and the wash basket.

18. The dispensing assembly of claim 10, wherein the user input button is configured for adding a mixture of supplemental water and a wash additive to the tub.

* * * * *